United States Patent [19]

Kupec et al.

[11] Patent Number: 4,684,932

[45] Date of Patent: Aug. 4, 1987

[54] METHOD AND ARRANGEMENT FOR MEASURING CHANGES OF CAPACITIVE STATE AT A SECURITY FENCE

[75] Inventors: Peter Kupec, Unterfoehring; Uwe Metzner; Peer Thilo, both of Munich, all of Fed. Rep. of Germany

[73] Assignee: Siemens Aktiengesellschaft, Berlin and Munich, Fed. Rep. of Germany

[21] Appl. No.: 638,765

[22] Filed: Aug. 8, 1984

[30] Foreign Application Priority Data

Aug. 16, 1983 [DE] Fed. Rep. of Germany ..... 3329554

[51] Int. Cl.[4] ..... G08B 13/26

[52] U.S. Cl. ..... 340/564; 340/664

[58] Field of Search ..... 340/564, 561-562, 340/541, 657, 664; 324/60 R, 60 C, 61 R; 256/10; 364/482-483; 307/355-358, 131

[56] References Cited

U.S. PATENT DOCUMENTS

| | | | |
|---|---|---|---|
| 2,971,184 | 2/1961 | Pearson et al. | 340/564 |
| 3,047,849 | 7/1962 | Hansen | 340/564 |
| 3,103,003 | 9/1963 | Roberts | 340/562 X |
| 3,778,807 | 12/1973 | Ralston | 340/564 |
| 4,389,646 | 6/1983 | Tago | 324/60 R X |
| 4,549,133 | 10/1985 | Metzner | 340/564 X |

FOREIGN PATENT DOCUMENTS

| | | | |
|---|---|---|---|
| 1220289 | 2/1967 | Fed. Rep. of Germany . | |
| 2539501 | 3/1977 | Fed. Rep. of Germany | 340/562 |
| 3110310 | 9/1982 | Fed. Rep. of Germany | 340/564 |
| 3110352 | 11/1982 | Fed. Rep. of Germany . | |
| 892872 | 4/1962 | United Kingdom . | |
| 479056 | 9/1975 | U.S.S.R. | 324/60 R |

*Primary Examiner*—Glen R. Swann, III
*Assistant Examiner*—Thomas J. Mullen, Jr.
*Attorney, Agent, or Firm*—Hill, Van Santen, Steadman & Simpson

[57] ABSTRACT

At a security fence comprising a plurality of electrodes disposed in parallel, a transmitter applies an alternating voltage to at least one of the electrodes. Remaining electrodes are grounded as receive electrodes. An ammeter measures electrode current and a measured value corresponding to an operating capacitance of this electrode is acquired and provided in every electrode circuit. Disruption factors are compensated on the basis of these measured values by means of comparison to earlier measured values of the same or of the other electrodes and by means of comparison to specific measured value patterns. An alarm is triggered only given non-compensatable measured values.

6 Claims, 4 Drawing Figures

$J_M$
AMMETER MEANS
7
BF
0,0001 Hz-10Hz
BAND PASS FILTER
7
7S
6E
1S
UM
SE
SABOTAGE RECOGNITION FILTER
U = 0
$J_T$ = 0
SAB
VG 1
7
SP 1
COMPARISON MEANS
MEMORY
VG 2
vg2
FURTHER COMPARISON MEANS
VG 3
vg3
AN 2
AL
VG4
vg4

METHOD AND ARRANGEMENT FOR MEASURING CHANGES OF CAPACITIVE STATE AT A SECURITY FENCE

BACKGROUND OF THE INVENTION

The invention relates to a method and to an arrangement for measuring changes of capacitive state at a security fence comprising a plurality of wire electrodes disposed in parallel. An alternating voltage is respectively applied to at least one of the electrodes and measuring signals are received at at least one electrode. A determination of a disruption or an alarm criteria are derived from chronological changes of the measuring signals.

It has long been known to identify the penetration of unauthorized persons into a protected area by means of capacitance measurements or by means of evaluating changes of capacitance, and to employ these for generating an alarm. Capacitive security fences are particularly employed for the surveillance of extensive open field installations, since all changes of state and thus the approach and penetration of unauthorized persons can be reliably acquired even in unsurveyable terrain. A problem given such security fences is that changes of capacitance are also effected by disruptive influences such as rain, snow, and frost, and also by birds and small animals which temporarily land on the electrodes or sneak under the fence. Insofar as possible, such disruptive influences should not, on the one hand, lead to the generation of an alarm whereas, on the other hand, a person penetrating the system must be reliably perceived and reported in all cases.

It is known, for example, to measure the interelectrode capacitances between transmission and reception electrodes and to evaluate the resulting difference of these interelectrode capacitances via a differential bridge in order to eliminate symmetrically occurring environmental influences (German Letters Patent No. 12 20 289, incorporated herein by reference). Given such bridge circuits, sudden changes in capacitance of a specific magnitude and steady changes of capacitance having a defined rate of change are employed as alarm criteria. Only a slight protection against disruption, however, exists with these relatively simple alarm criteria.

It is likewise already known (German OS No. 31 10 352 incorporated herein by reference), to measure the interelectrode capacitances and the self-capacitances of an electrode system by means of reversing the potentials of the individual electrodes. The measured results, namely all system capacitances, are thus evaluated via microcomputers so that a high reliability against disruption is achieved. This method has the disadvantage, however, that a multitude of complicated switchover devices must be provided in the proximity of the electrodes and that relatively high potentials must thereby be switched between the individual electrodes. Furthermore, only one interelectrode capacitance or self-capacitance can be acquired per measurement. A complete measurement therefore takes a relatively long time because of the response times when switching over.

The earlier German patent application No. P 32 22 640.3, incorporated herein by reference, likewise also discloses a method wherein the interelectrode capacitances and self-capacitances of an electrode system can all be measured simultaneously by means of employing different frequencies. A high reliability against disruption can also be achieved in this case by means of evaluation via microcomputers. Yet this method also has the disadvantage that a high circuit expense for the transmitters and receive devices with corresponding filters is required because of the different test frequencies.

SUMMARY OF THE INVENTION

An object of the invention is to create a measuring method and an arrangement for measuring changes of capacitive state of the type initially cited wherein the circuit expense for the measurement is considerably reduced in comparison to known methods and a high reliability against disruption is nonetheless guaranteed.

This object is inventively achieved in that the intensity of current is respectively identified as a measuring signal in each of the connected electrodes and a measured value for the operating capacitance of the corresponding electrode is acquired therefrom.

Disruption or alarm signals are derived from the change of the measured values of individual electrodes in comparison to their respective quiescent value and/or in comparison to the remaining electrodes.

A plurality of measured values corresponding to the number of electrodes, and thus a high redundancy of the alarm criterion are obtained with the current measurement at the individual electrodes according to the invention. Every measured current value is proportional to the operating capacitance of this corresponding electrode given a specific connection in the overall electrode system. It is therefore not necessary to identify the individual interelectrode capacitances and self-capacitances.

The measured values corresponding to the number of electrodes can be evaluated via the known properties allocated to the respective electrode. For example, electrode thickenings which simultaneously appear at all electrodes can be identified as accumulation of water, snow or frost and can be compensated in the evaluation.

It is preferable for the compensation of uniformly acting disturbing influences such as meteorological effects to form an average value from the measured values of all electrodes, and to compare every individual measured value which is multiplied by a factor derived from the geometrical arrangement with this average value. Given general meteorological influences, the difference between the average value and the individual values provided with a factor must then yield approximately zero. When, however, this difference significantly departs from zero for individual electrodes, then it can be concluded therefrom that an object which has significantly altered the capacitance over and above the meteorological influences is specifically situated at these electrodes.

There are also characteristic time/current curves or time/operating capacitance curves for a human intruder which seriously differ from the disturbance curves. Thus, the penetration of a person between two electrodes can be discriminated from a bird landing thereon in that the steepness of the current change is compared to prescribed patterns. For discrimination between a person and a small animal that is slipping through, the fact that the current changes of adjacent electrodes are defined by the mass of the approaching body can be employed, so that comparison to prescribed patterns also enables a discrimination in this case.

It can be advantageous for special situations to connect all electrodes to the alternating voltage of the transmitter as transmit electrodes. It is generally expedient for security fences, however, to connect a portion of the electrodes as transmit electrodes and a portion of them as grounded receive electrodes, whereby the successively disposed electrodes in a particularly advantageous embodiment are respectively alternately connected as transmit electrodes and as receive electrodes. A particularly good and redundant alarm statement can be acquired by means of measuring the transmitter and receiver currents, since the changes of transmitter and receiver currents are opposed for an intruder penetrating the fence. The evaluation of the current measurements, moreover, becomes particularly simple when the transmit electrodes are all connected to the same voltage and the receive electrodes are connected to grounded potential.

An arrangement for the implementation of the method according to the invention is expediently constructed such that a transmit means is connectible to one or more electrodes, that ammeter means for measuring the intensity in each of the electrodes are provided, and that the ammeter means are followed by an evaluation circuit comprising comparison means for the comparison of the individual measured values to the simultaneously identified measured values of the remaining electrodes, to the measured values of the respectively same electrode identified at an earlier point in time, and to stored values.

DESCRIPTION OF THE PREFERRED EMBODIMENTS

Figure 1:
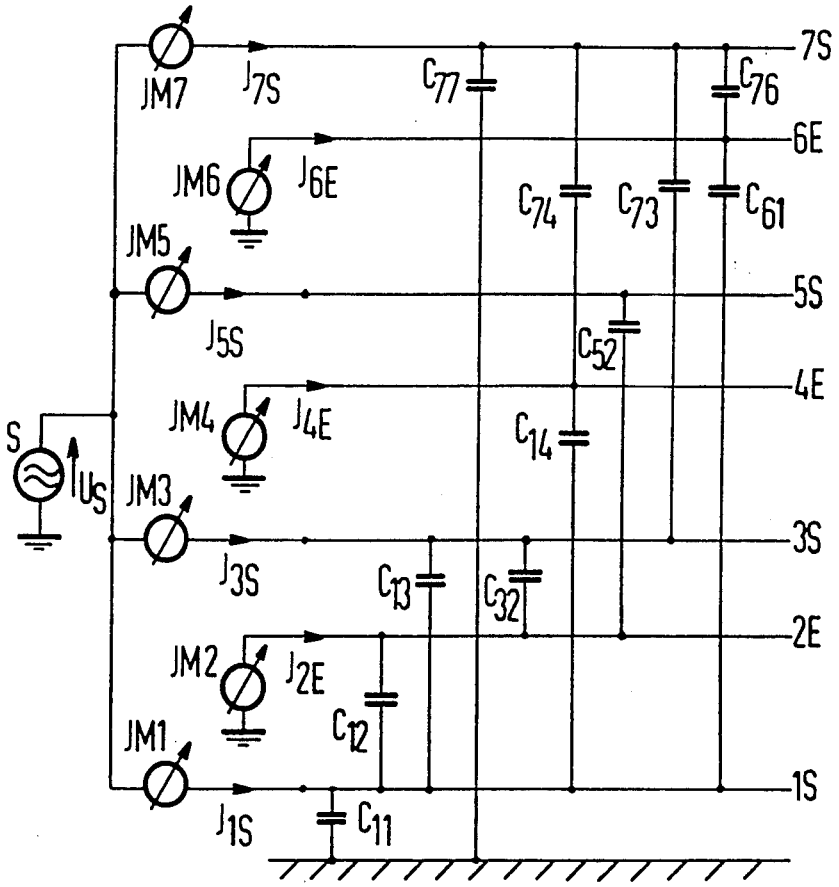
FIG. 1 is a schematic arrangement of a security fence with transmitter and ammeter means.

FIG. 1 schematically shows a security fence comprising seven electrodes which are alternately connected as transmit electrodes and as receive electrodes in the sequence of their disposition above one another. The transmit electrodes 1S, 3S, 5S, and 7S are thus all connected to a common alternating current transmitter S which generates an alternating voltage $U_S$ of, for example, 100 V and 10 kHz. The receive electrodes 2E, 4E, and 6E, by contrast, are all connected to grounded potential. Every electrode has a self-capacitance relative to the grounded potential, for example the electrode 1S has the capacitance $C_{11}$ or the electrode 7S has the self-capacitance $C_{77}$. Respective interelectrode capacitances exist between the individual electrodes, for example the capacitance $C_{12}$ between the electrodes 1S and 2E or the capacitance $C_{52}$ between the electrodes 5S and 2E. Of course, not all of the possible interelectrode capacitances have been shown in FIG. 1 for purposes of clarity.

One of the ammeter means JM1 through JM7 is inserted into the circuit of each and every electrode, whereby the respective current $J_{1S}$, $J_{2E}$ . . . through $J_{7S}$ flowing in the corresponding transmit or receive electrode is measured upon application of the transmission voltage $U_S$ to the transmit electrodes. A switching of potential when measuring is thus not required; a single transmission frequency also suffices. The current measured in the respective electrode is proportional to the operating capacitance of this corresponding electrode. The following relations apply for the illustrated example of FIG. 1 to which are applied the individual currents given the same transmission voltage US'.

$$J_{1S} = j\omega U_S \cdot (C_{11} + C_{12} + C_{14} + C_{16}) = j\omega U_S \cdot C_1$$

$$J_{2E} = j\omega U_S \cdot (C_{12} + C_{32} + C_{52} + C_{72}) = j\omega U_s \cdot C_2$$

.

.

.

$$J_{7S} = j\omega U_S \cdot (C_{77} + C_{71} + C_{73} + C_{75}) = j\omega U_S \cdot C_7$$

The parenthetical sum of the respective interelectrode capacitances and self-capacitances is thus the operating capacitance for the corresponding electrode. Given a system of m electrodes, n currents or n operating capacitances $C_I$ with $I=1 \ldots m$ are thus measured with the inventive method. n measured values for further evaluation can be acquired therefrom. An identification of the individual interelectrode capacitances or self-capacitances thus not required.

Figure 2:
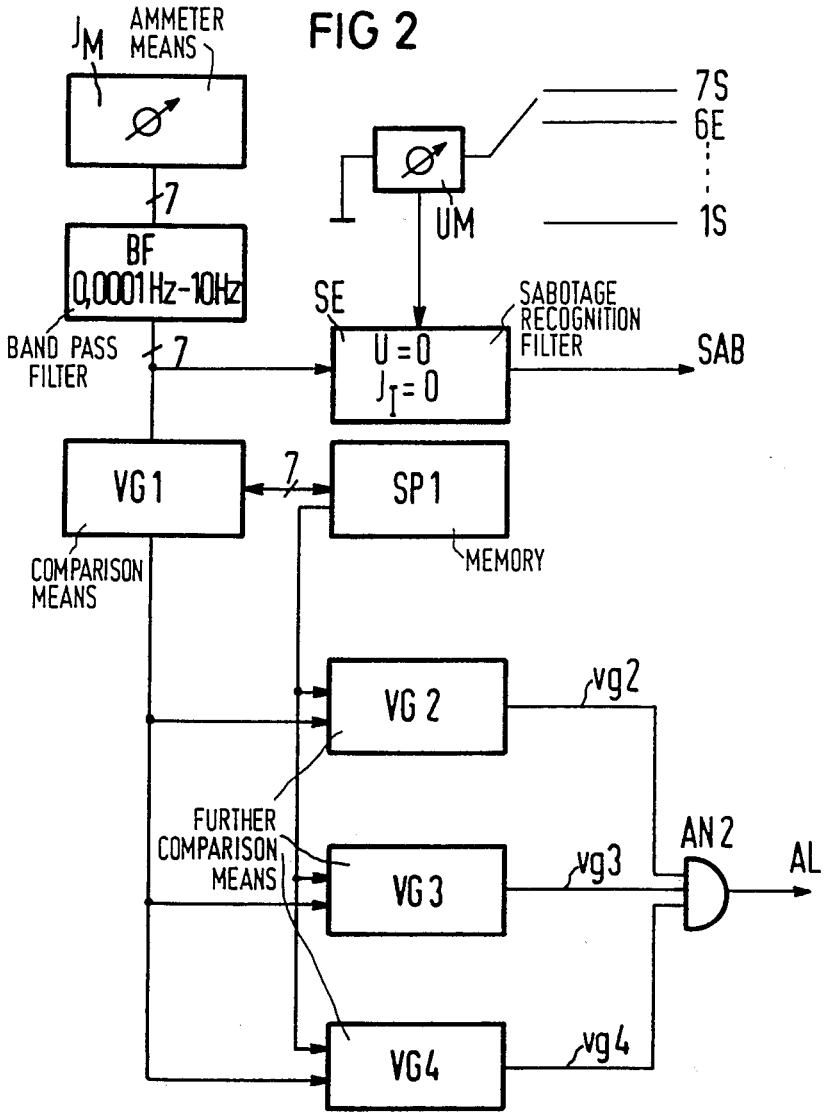
FIG. 2 is a block diagram for the evaluation of the measured values acquired at the security fence.

FIG. 2 shows in a block diagram the evaluation of the measured signals acquired according to FIG. 1. The seven measured current values are conducted from the ammeter means JM which, for example, contains the seven ammeter devices JM1 through JM7 from FIG. 3 via a band pass filter BF in order to suppress higher-frequency events. For example, the band pass filter covers a range from 0.0001 Hz through about 10 Hz. Instead of the individual measuring devices JM1 through JM7, of course, the ammeter means JM can also contain a single measuring device with which the seven electrodes are sampled in multiplex technology. At every sampling, the new measured values are compared in a comparison means VG1 to the earlier measured values of the same electrodes which are contained in a memory SP1. When the values are unaltered in comparison to the earlier values or in comparison to quiescent values, then there is no need for further processing. The measured values are stored, however, for a certain time so that a certain number of comparative measured values from preceding samplings are available.

When the measured values (n) have changed relative to an earlier sampling (n−1), then the comparison means VG1 generates a signal for the further comparison means VG2, VG3, and VG4. Given presence of this signal, the measured values for the operating capacitances $C_I$ ($I=1 \ldots 7$) are supplied from supplied comparison means VG1 or via the memory SP1 to the further comparison means VG2, VG3, and VG4. Alarm criteria are derived in these comparison means according to various points of view.

Figure 3:
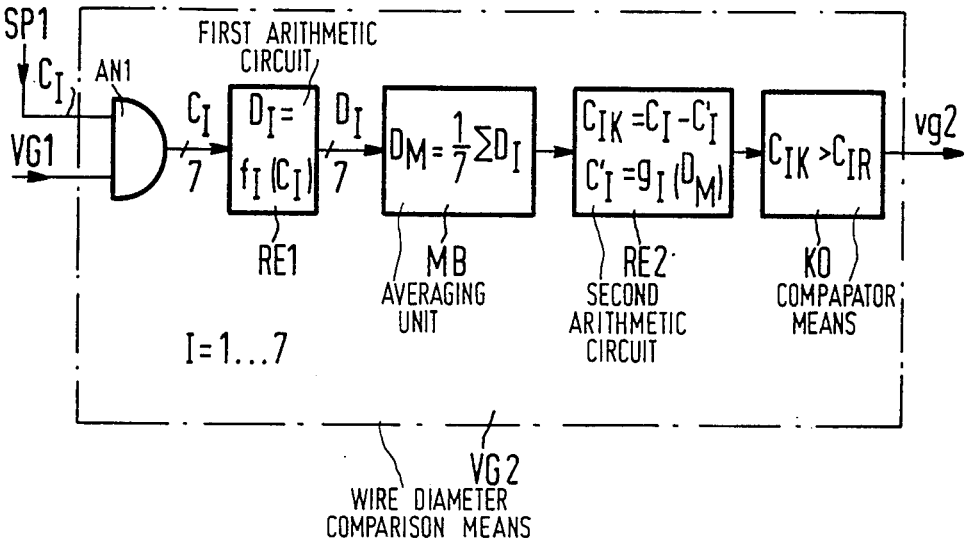
FIG. 3 is a more detailed circuit of the function units in the comparison means VG2.

The functioning of the comparison means VG2 may be seen with reference to FIG. 3. With the signal from the comparison means VG1, the measured values of the operating capacitances $C_I$ are forwarded via an AND element AN1 to a first arithmetic circuit RE1. A corresponding wire diameter $D_I$ is calculated in this arithmetic circuit for every operating capacitance. The wire diameter is a function $f_I$ of the operating capacitance $C_I$. This function is different for every wire. These functions $f_I(C_I)$ are therefore experimentally determined for every electrode when the system is set up and are stored in the first arithmetic circuit RE1. As long as the electrodes are unchanged, the actual electrode diameter D is calculated in the arithmetic circuit RE1. This electrode diameter can become enlarged due to meteorological influences, for example due to frost. This results in a corresponding change in the measured operating capacitance. But other influences such as a landing bird or the penetration of a person can also change the operating capacitance such that an apparently enlarged electrode diameter is calculated in the arithmetic circuit RE1.

An average value is then formed in the averaging unit MB from the electrode diameters $D_I$ (I=1 . . . 7) calculated in the arithmetic circuit RE1. These are calculated according to the relationship $$D_M = \frac{1}{7} \cdot \Sigma D_I.$$

This average value $D_M$ is then supplied to a second arithmetic circuit RE2.

In the second arithmetic circuit RE2, the average value $D_M$ is in turn converted into a value for the operating capacitance for each individual electrode, namely according to the relationship $C'_I = g_I(D_M)$.

The function $g_I$ is the inverse function to the above-described function $f_I$ for every individual electrode and indicates the dependency between electrode diameter and operating capacitance for the normal condition of the individual electrodes. Like the values for $f_I$, the values for $g_I$ for I=1 . . . 7 are experimentally identified for the system in its normal condition or are calculated from $f_I$ and written into the arithmetic circuit RE2. The value $C'_I = g_I(D_M)$ is now respectively formed there for each electrode from the average electrode diameter value $D_M$ via the function $g_I$ and is subtracted from the measured value for the operating capacitance $C_I$. This yields a compensated measured value of the operating capacitance $C_{Ik}$ for every electrode. A value of approximately 0 results for all electrodes by means of this compensation of the measured values via the described averaging and subtraction as long as there is a uniform electrode thickening due to meteorological influences. When, however, the differential amount, i.e. the compensated value $C_{Ik}$, significantly differs from 0 or a threshold $C_{IR}$ for individual electrodes, then an intruder can be perceived therefrom. For this purpose, the values $C_{Ik}$ are supplied to a comparator means KO in which a threshold $C_{IR}$ is stored for each electrode. When the comparator means determines that a value $C_{Ik}$ is greater than the corresponding threshold $C_{IR}$, then a signal vg2 is emitted at the output.

In order to be able to further discriminate whether the identified intruder is a bird, a small animal, or a person, the measured value $C_I$ of the individual electrodes are supplied to further comparison means VG3 and VG4.

The steepness of the change of a measured value is identified in the comparison means VG3 by comparison to the stored measured values of the preceding sampling from the memory SP1, and is compared to a prescribed pattern. The fact is thus utilized that, for example, a bird approaches the fence significantly faster than a human can.

Figure 4:
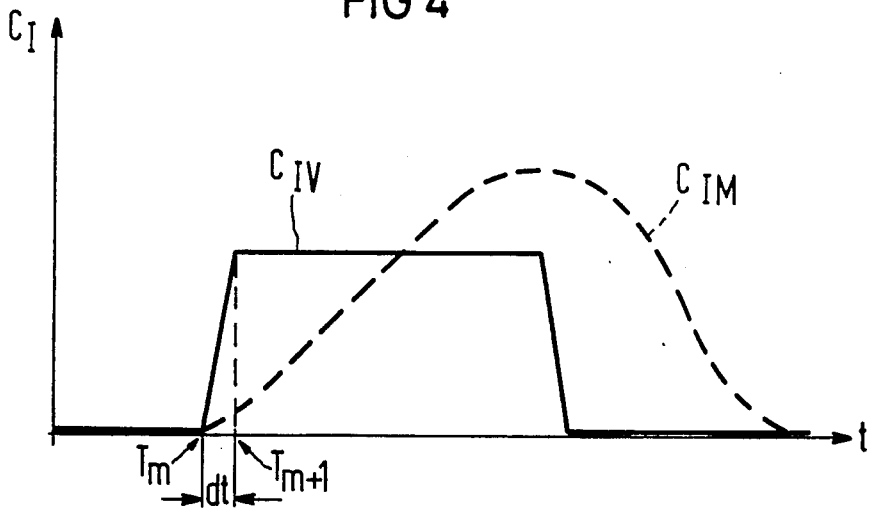
FIG. 4 is a diagram for illustrating the changes of capacitance on the basis of different approach speeds of a bird and of a human.

FIG. 4 shows a diagram related thereto, whereby a typical curve of the operating capacitance $C_I$ is illustrated over time. The curve $C_{IV}$ represents the curve of the measured value when a bird flies up. A steep rise in the operating capacitance $C_I$ is identified between the two measuring times $T_m$ and $T_{m+1}$. The operating capacitance remains the same after this until a steep drop in the operating capacitance at a later point in time indicates that the bird has flown away. In comparison thereto, the curve for the approach of, for example, a person crawling under the fence shows a completely different progression. Between points in time $T_m$ and $T_{m+1}$, the curve $C_{IM}$ shows a relatively slow rise and also correspondingly shows a slower drop at a later point in time. A signal is therefore derived in the comparison means VG3 (FIG. 2) from the approach speed of the intruder, i.e. from the chronological curve of the change in $C_I$, in comparison to a threshold $C_{IV}$. The alarm criterion is thus derived from the condition $$\frac{dC_I}{dt} > C_{IV}.$$

The changes in measured value identified in comparison to the preceding samples are compared in the comparison means VG4 to stored pattern values. These pattern values place a limit on the alarm emission when the mass and the change in measured value caused by this mass is to be allocated to the pattern of a small animal or of a bird in comparison to the pattern caused by the mass of a human body. This occurs in a simple manner in that the absolute change in measured value $\Delta C_I$ corresponding to the mass of the intruder is placed in a comparative relationship with a threshold $C_{IM}$. The threshold can thus be different for the receive electrodes and for the transmit electrodes. This threshold or these thresholds are likewise experimentally identified for the corresponding system and stored in the comparison means VG4. The alarm criterion vg4 can be derived from the relationship $$\Delta C_I > C_{IM}$$

for every interrogation in case the change in the operating capacitance due to the mass of the penetrating body lies above the threshold.

An alarm signal AL is only triggered via the AND element AN2 when the identified changes of the measured value cannot be completely compensated either by means of the average value formation in the comparison means VG2, by means of the steepness-qualified compensation in the comparison means VG3, or in the limiting compensation of the comparison means VG4.

A sabotage recognition unit SE is also provided in a known manner in addition thereto, as shown in FIG. 2. The measured values of current from the ammeter means JM for the individual electrodes as well as the measured voltage value at the individual electrodes are supplied to this sabotage recognition means SE. A measuring device UM which is connectible to the individual electrodes 1S through 7S via a sampling switch for every interrogation serves for voltage measurement. When an identification is made in the sabotage recognition means SE that the voltage is dropping sharply or is approaching 0, or that the electrode current $J_I$ at one of the electrodes is approaching 0, then a short or a wire break is perceived on the basis thereof and is evaluated to generate a sabotage signal SAB.

The described evaluation of the measured signals is preferably undertaken by means of a microcomputer in which the respective measured values and the values required for comparison are stored, and which executes the comparison operations.

For the evaluation of the measured values in units VB1, VG2, VG3, and VG4 the program set forth hereafter is employed:

```
0   CYCLE
1   CYCLE
    WHEN
    (ABS (C1(n)—C1(n-1)).GT.0.OR.ABS(C2(n)—C2(n-1)).
    GT.0.OR. . . . )
    BREAK
    END 1
2   CYCLE
    DO I = 1,7
    DI = fI(CI)
    DM = 1/7 Σ DI
    C'I = gI(DM)
    WHEN
    ((C1-C'1).GT.C1R.OR.(C2-C'2).GT.C2R.OR. . . . )
    BREAK
    END 2
3   CYCLE
    WHEN
    ((C1-C'1)n-(C1-C'1)n-1.LT.C1V.OR.(C2-C'2)n
    (C2-C2)n-1.LT.C2V.OR. . . . )
    BREAK
    END 3
4   IF
    ((C1-C'1).GT.C1M.OR.(C2-C'2).GT.C2M.OR. . . . )
    THEN ALARM
    END 4
END 0
```

Although various minor changes and modifications might be proposed by those skilled in the art, it will be understood that we wish to include within the claims of the patent warranted hereon all such changes and modifications as reasonably come within our contribution to the art.

We claim as our invention:

1. A method for detecting an alarm or malfunction condition at a security fence by measuring operating capacitance changes thereof, the security fence having a plurality of wire electrodes arranged in parallel, comprising steps of:

connecting at least one of the electrodes with an AC voltage so it serves as a transmit electrode and connecting at least one of the remaining electrodes as a receive electrode;

identifying for each transmit and receive electrode a standard operating capacitance and storing said standard operating capacitance;

measuring a respective current flow in each of the transmit and receive electrodes which is proportional to an operating capacitance of each of the transmit and receive electrodes and determining an operating capacitance for each of the transmit and receive electrodes, the operating capacitances being a function of a capacitance of the respective transmit or receive electrode to ground, a geometric size of the respective transmit or receive electrode, and its geometric spacing relative to the other electrodes;

repeatedly measuring the operating capacitance for every transmit electrode and every receive electrode and comparing the respective measured operating capacitance to the respective standard operating capacitance for each such electrode;

given a deviation in a respective operating capacitance compared to the respective standard operating capacitance utilizing the respective operating capacitance to calculate actual electrode diameter and determining swelling in relation to electrode swellings of other of said plurality of wire electrodes, utilizing the respective operating capacitance to obtain a variation of said measured operating capacitance with time and determining a rate of change of operating capacitance, and utilizing the respective operating capacitance to determine an absolute change of said variation of said respective operating capacitance with time; and employing results from the determined electrode swelling, determined rate of change, and absolute change to decide whether or not an alarm or malfunction condition exits at said security fence.

2. A method according to claim 1 wherein for determining the swelling of the electrode wire, calculating an electrode wire diameter corresponding to every operating capacitance for every transmit and receive electrode when the fence is in a normal state, and forming a mean value from all transmit and receive electrode wire diameters; and comparing to the mean value each of the operating capacitances determined for each of the transmit and receive electrodes during the constant identification procedure.

3. A method according to claim 1 wherein the transmit and receive electrodes are alternately arranged.

4. A method according to claim 1 wherein every electrode of the fence is either a transmit electrode or a receive electrode.

5. A method according to claim 4 wherein all transmit electrodes are fed from a common voltage.

6. A method according to claim 1 wherein all receive electrodes are connected through a current measuring device to ground and all transmit electrodes are connected in common to the AC voltage.

* * * * *